US006844862B1

(12) United States Patent
Cencich et al.

(10) Patent No.: US 6,844,862 B1
(45) Date of Patent: Jan. 18, 2005

(54) WIDE ANGLE PARACONIC REFLECTOR ANTENNA

(75) Inventors: Tom Cencich, Littleton, CO (US); Tom Milligan, Columbine, CO (US); Jason Burford, Arvada, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/364,928

(22) Filed: Feb. 11, 2003

Related U.S. Application Data

(60) Provisional application No. 60/356,290, filed on Feb. 11, 2002.

(51) Int. Cl.[7] ..... H01Q 19/10; H01Q 13/00

(52) U.S. Cl. ..... 343/832; 343/781 R

(58) Field of Search ..... 343/781 R, 781 CA, 343/832, 837, 840, 761, 775, 779, 782, 834, 839

(56) References Cited

U.S. PATENT DOCUMENTS 4,201,992 A 5/1980 Welti ..... 343/840
4,607,260 A * 8/1986 Dragone ..... 343/786
4,672,387 A 6/1987 Waddoup et al. ..... 343/781
4,965,869 A * 10/1990 Fortney ..... 343/781 R
5,486,838 A 1/1996 Dienes ..... 343/781
5,557,292 A * 9/1996 Nygren et al. ..... 343/781 P
5,616,892 A 4/1997 Ferralli ..... 181/155
5,706,017 A 1/1998 Buttgenbach ..... 343/753
6,160,520 A 12/2000 Muhlhauser et al. ..... 343/755
6,570,528 B1 * 5/2003 Rao et al. ..... 342/354

* cited by examiner

*Primary Examiner*—Don Wong
*Assistant Examiner*—Minh Dieu A
(74) *Attorney, Agent, or Firm*—Marsh Fischmann & Breyfogle LLP

(57) ABSTRACT

A wide-angle reflector antenna that substantially eliminates pattern blockage is provided. The reflector antenna includes a paraconic reflector and a feed supportably located in opposed relation to the reflector surface. A curved reflecting surface of the reflector is formed by symmetrically rotating a curve around a longitudinal center axis, wherein the curve also defines an apex on the longitudinal center axis. The curve's focal point may be located on the longitudinal center axis or laterally displaced therefrom.

39 Claims, 6 Drawing Sheets

FIG. 5A
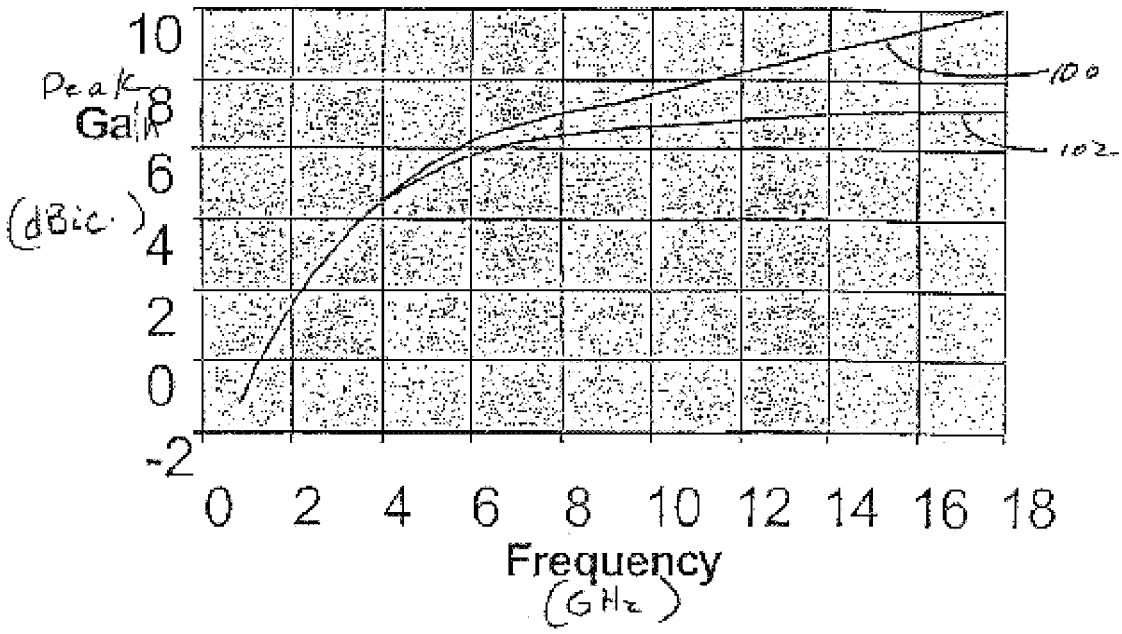
Gain / Coverage @ 18 GHz
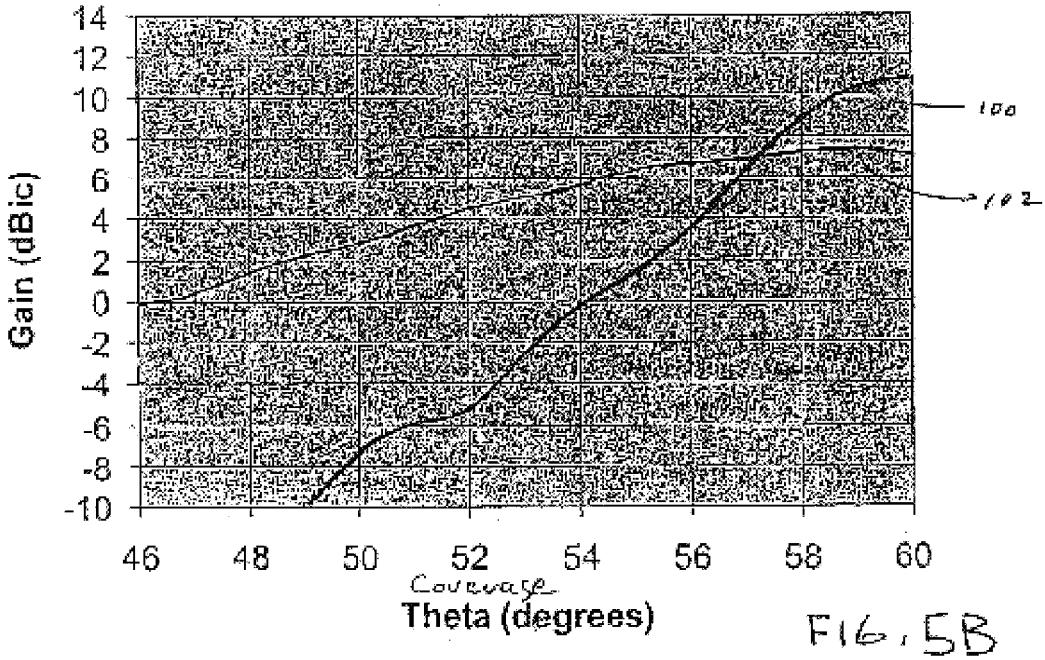
FIG. 5B

FIG. 6A
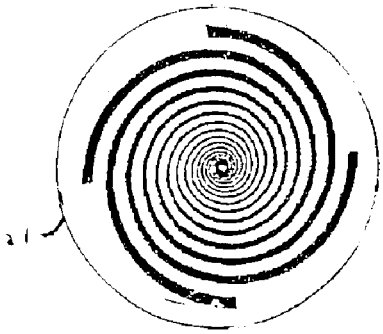
FIG. 6B
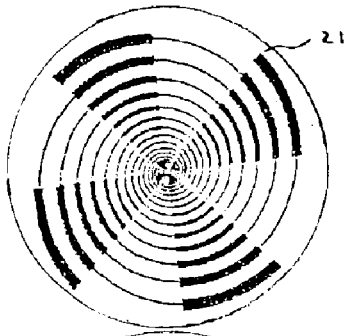
FIG. 6C
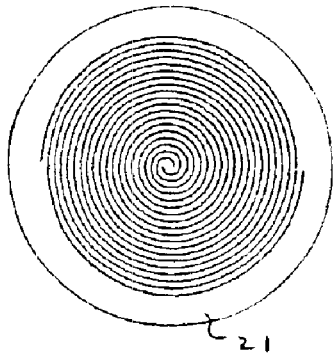
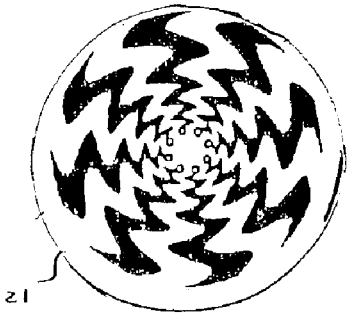
FIG. 6D
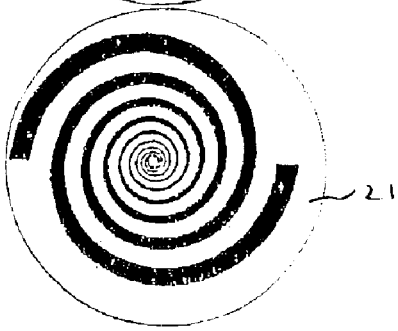
FIG. 6E
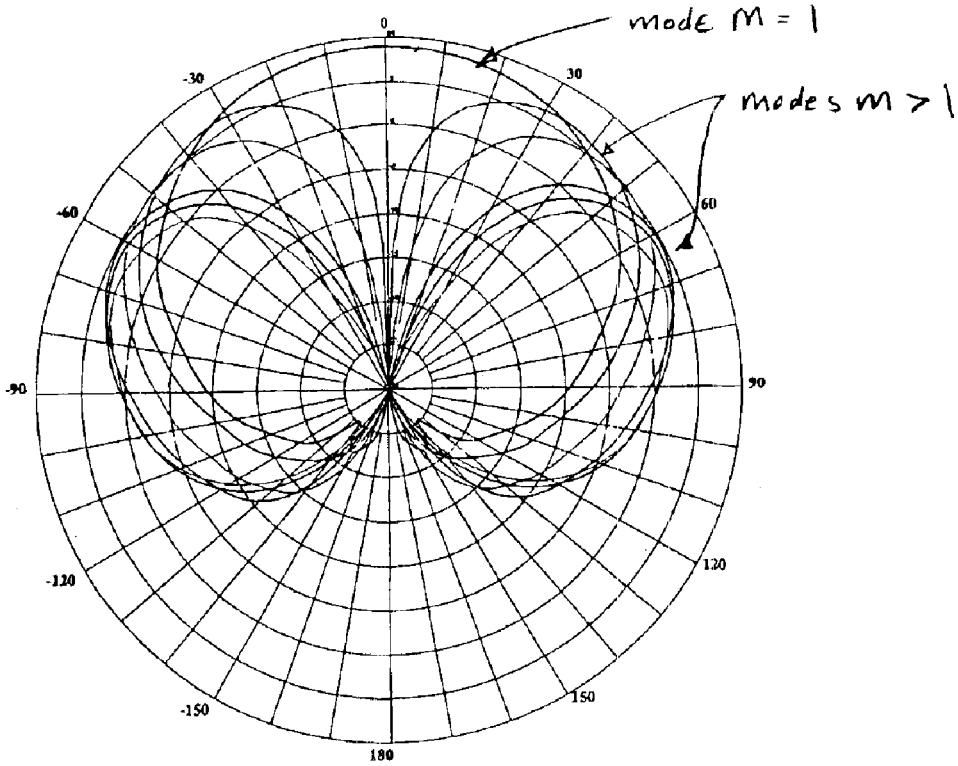
FIG. 7

WIDE ANGLE PARACONIC REFLECTOR ANTENNA

RELATED APPLICATIONS

This application claims priority under 35 USC §119(e) to U.S. Provisional Patent Application No. 60/356,290 entitled "WIDE ANGLE PARACONIC REFLECTOR ANTENNA" filed Feb. 11, 2002, which is incorporated herein by reference in its entirety.

FIELD OF THE INVENTION

The present invention relates to reflector-type antennas, and more particularly, to a reflector antenna that provides wide-angle coverage, e.g. an annular or conical pattern. The inventive reflector antenna is particularly apt for spaceborne applications.

BACKGROUND OF THE INVENTION

Antennas are configured to transmit and receive radiation beams having particular, desired patterns. Generally, antennas are reciprocal in that they exhibit similar properties in both transmission and reception modes of operation. As such, while descriptions of antenna performance are often expressed in terms of either transmission or reception, the capability to operate comparably in either mode is understood. In this regard, the terms "aperture illumination," "beam" and "radiation pattern" may pertain to either a transmission or reception mode of operation. Relatedly, the same antenna "feed" may be employed for both the transmission and reception of signals.

As noted, different antenna configurations are used for different applications. For example, reflector antennas may be used for providing high gain in radar and communications applications. Of particular interest, various reflector antennas utilize a parabolic reflecting surface. Waves arriving at a parabolic reflecting surface in phase are reflected to a focal point along equi-distant paths, thereby arriving at the focal point in phase. Waves leaving a feed located at a focal point reflect off of a parabolic surface to result in a planar wavefront collimated along a focal axis, thereby producing a narrow beam of directed, focused energy.

Various antennas with parabolic reflecting surfaces have been proposed for spaceborne applications, including antennas having paraboloidal reflectors. In the later regard, while an increased diameter of a paraboloidal reflector can increase its gain and efficiency, the desire to limit the size and weight of spaceborne antenna platforms presents a challenging trade-off. Further, the placement of feed componentry can compromise pattern coverage, particularly where wide-angle coverage is desired. Additionally, feed componentry placement in spaceborne applications raises attendant concerns in relation to environmental exposure and outboard mass.

SUMMARY OF THE INVENTION

In view of the foregoing, an object of the present invention to provide an antenna that provides high gain and wide-angle coverage with reduced size and weight, and that is particularly apt for spaceborne applications.

It is also an object of the present invention to provide an antenna that yields wide-angle coverage with reduced feed componentry interference, and that is particularly apt for spaceborne applications.

The noted objectives and additional advantages are realized by an inventive reflector antenna that includes a paraconic reflector having a curved reflecting surface (e.g. convex in side view) that is defined by rotating a curve at least partially around a longitudinal center axis, wherein the curve also defines an apex on the longitudinal center axis. The reflector antenna further includes a feed spaced from and supportably located in opposing relation to the reflector. As may be appreciated, the reflector and feed may be mounted to a support structure, such as the deck of a spaceborne vehicle (e.g. a satellite).

In operation, a radiation beam may be transmitted by the feed and reflected by the reflector to yield the desired high gain and wide-angle coverage. When the curved reflecting surface of the reflector completely surrounds the longitudinal center axis a conical coverage pattern may be realized.

As may be appreciated, the reflector and feed may be provided so that a focal point or ring of the reflector is coincidental with a feed phase center or feed ring of the antenna feed. In other arrangements, the feed phase center or ring focus may be offset from the focal point or ring by a predetermined amount to obtain a specifically desired beam pattern.

The curve used to define the curved reflecting surface of the reflector may be substantially parabolic or non-parabolic. To obtain the desired beam, a vertex of the curve may be laterally offset from the longitudinal center axis. Relatedly, the curve may be selected so that a focal point thereof is either located on the longitudinal center axis or laterally displaced therefrom by a predetermined amount. In the later case, the curved reflecting surface will have a focal ring that extends around an imaginary cylinder (e.g. centered on the longitudinal center axis) whose radius coincides with the lateral displacement.

A major axis of the curve used to form the curved reflecting surface may be defined by a line extending between the vertex and focal point of the curve. In typical spaceborne applications, the major axis may be tilted at an angle (e.g. an acute) relative to the longitudinal center axis, such tilt angle being selected so as to point the reflected radiation in a desired direction.

The feed may comprise a feed antenna, e.g. preferably capable of providing circularly symmetric radiation. In this regard, the feed antenna may be of a "feed-ring" type that generates a loop current ring(s) upon excitation, such as a spiral antenna (e.g. log-spiral or Archimedean), a sinuous antenna or a log-periodic antenna. Such antennas generally comprise two or more elements disposed on a planar, conical or other appropriate support surface. A spiral antenna having three or more spiral arms may be utilized for multimode operations (e.g. direction finding and tracking applications) and to yield relatively large bandwidths for dual-polarization arrangements. Numerous other antenna types may also be employed, e.g. including monopole, cross dipole, horn, log-periodic dipole array and phased array antennas.

The reflector and feed may be provided so that a focal point or ring of the reflector is centered upon a feed phase center or feed ring of the feed antenna. For example, a curved reflecting surface may be utilized that has a focal point located at the center of the feed phase center or feed ring. Alternatively, a curved reflecting surface may be utilized that has a focal ring centered upon the feed phase center or feed ring. In either case, the feed antenna preferably may be circularly symmetric with the reflector and centered upon a longitudinal center axis of the main reflector to facilitate beam uniformity. In other arrangements, the feed phase center or feed ring may be offset from the antenna focal point or ring by a predetermined amount to obtain a specific far-field beam pattern.

As noted above, the feed of the inventive reflector antenna is supportably located in opposing relation to the reflector. For such purposes, the antenna reflector may further comprise a support member.

In one embodiment, the support member comprises a post that extends away from the reflector along the longitudinal center axis. For example, one end of the post may be anchored to a support structure adjacent to the reflector. In turn, a feed antenna is supportably interconnected to a free end of the post. Again, the curved reflecting surface may be defined by curve having a focal point on or laterally displaced from the longitudinal center axis. A center hole through the reflector may be provided to accommodate positioning of the post therethrough.

In conjunction with this embodiment, it may be preferable to utilize a feed antenna with a null on the longitudinal center axis, wherein any post interference with beam transmission/reception is minimized. For example, a spiral antenna having at least three spiral arms for higher mode radiation patterns (e.g. M>1) may be employed.

Feed cabling may be conveniently routed from the feed antenna through the post to additional feed componentry disposed rearward of the reflector. For example, such componentry may be mounted directly on or within a support structure, e.g. a deck of a spaceborne vehicle (e.g. a satellite).

To increase efficiency and/or optimize aperture illumination, the reflector antenna may further include a lens positioned over the feed antenna and supportably interconnected to the post. For example, a hemispherical, dielectric lens may be employed. The lens may include an aperture for receiving the post therethrough.

In another embodiment, the support member may comprise a radiolucent support adapted for positioning over the reflector. By way of example, a radiolucent radome or shaped foam member may be utilized. In turn, a feed antenna may be mounted to the radome or foam member in opposing relation to the reflector. For example, a feed antenna may be connected to a feed housing (e.g. to define a cavity-backed antenna structure), and the feed housing may be supportably located within an opening of a radome that is axially aligned with and positioned over the reflector.

For this embodiment, the paraconic reflector shape may be defined so that the curved reflecting surface has an apex, wherein the reflector presents a continuous reflecting surface across the lateral extent thereof. The apex may be disposed on the longitudinal center axis and optically aligned with the center of the feed antenna to facilitate beam uniformity.

In conjunction with this embodiment, the feed antenna may be fed via feed cabling or fiber optic lines that extend from a backside of the feed housing and wind about the radiolucent support. In this regard, feed cabling may be provided within an absorber (e.g. a carbon-based foam or honeycomb) that reduces radiation scatter. The feed cabling may be wound around the support at a predetermined angle to spread any beam blockage over an azimuth area. For example, the predetermined angle should preferably be selected so that the feed cabling is wound no more than once around the support.

Additional aspects and advantages of the present invention will become apparent upon consideration of the description that follows.

BRIEF DESCRIPTION OF THE DRAWINGS

FIGS. 5A and 5B show gain/frequency and gain/beamwidth performance plots, respectively, for two embodiments for the present invention.

FIGS. 6A–6E illustrate exemplary feed antennas that may be utilized according to various embodiments of the present invention.

FIG. 7 illustrates beamplots associated with various operating modes of a feed antenna employable in various embodiments of the present invention.

DETAILED DESCRIPTION

Figure 1A:
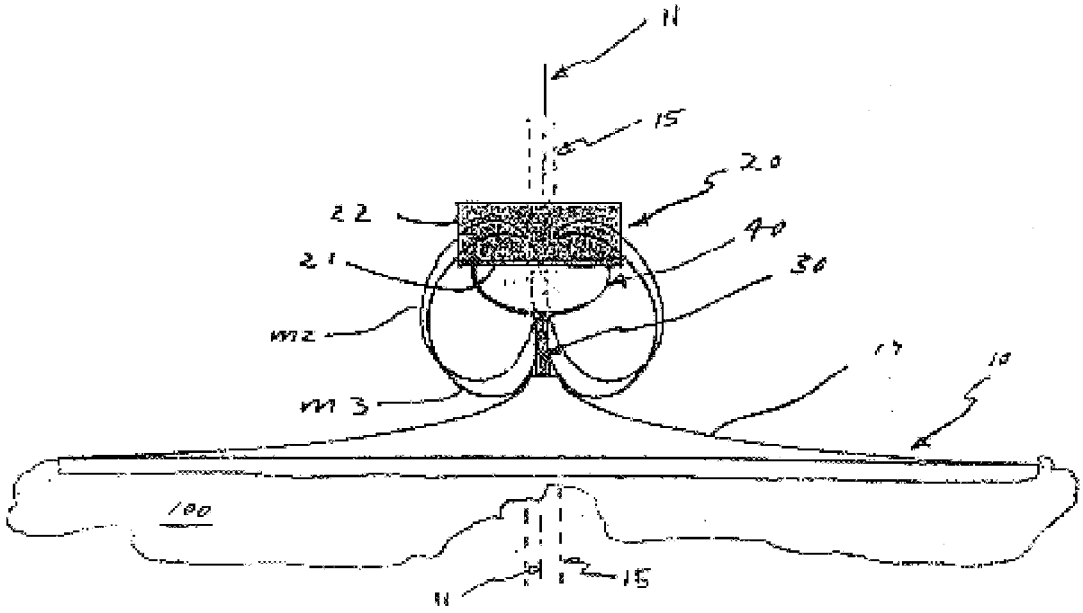
FIG. 1A illustrates a side view of a reflector antenna according to one embodiment of the present invention, wherein a post is utilized to support a feed relative to a reflector.
Figure 1B:
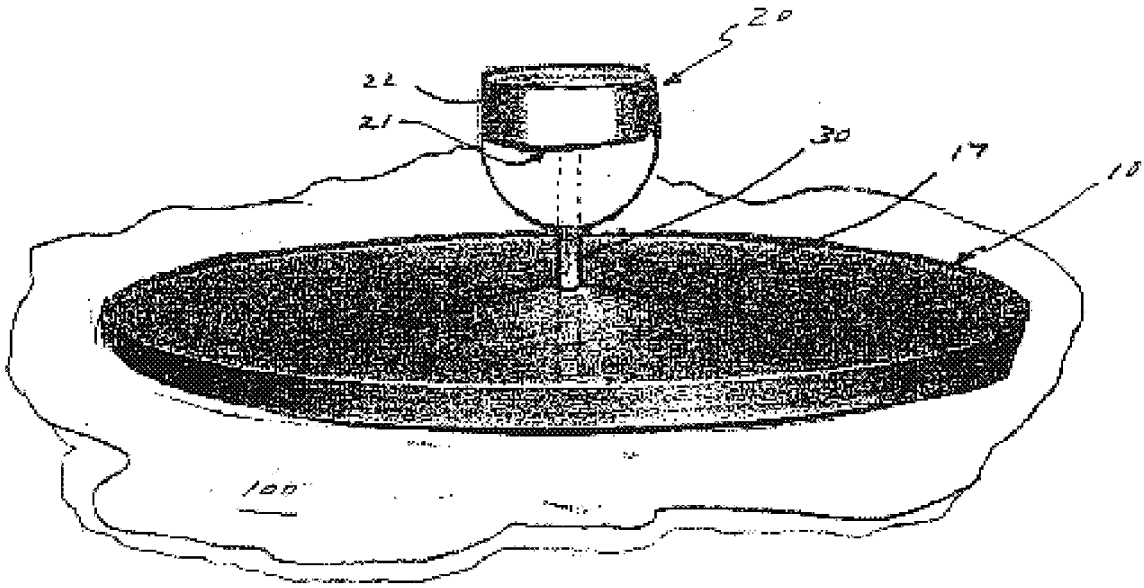
FIG. 1B illustrates a perspective view of the embodiment of FIG. 1A.

In the embodiment of FIGS. 1A and 1B a paraconic reflector antenna comprises a reflector 10 and a feed 20 supportably disposed in opposing relation to the reflector 10 by post 30. The reflector 10 and post 30 may be mounted on a support structure 100, such as the deck of a spaceborne vehicle (e.g. a satellite). In operation, radiation beams are transmitted by feed 20 and reflected by reflector 10 to yield wide-angle, annular coverage.

The post 30 may be located on the longitudinal center axis 11. In this regard, the post 30 may be positioned in a center hole provided through reflector 10.

The reflector 10 includes a curved reflecting surface 17 that is defined by a curve symmetrically rotated about a longitudinal center axis 11. As shown by FIG. 1, the curved reflecting surface 17 may generally define a truncated cone having dish-shaped sides in a side view. The curve used to define the curved reflecting surface 17 may be selected to have a focal point on or laterally displaced from the longitudinal center axis 11. In the later case, the curved reflecting surface 17 will have a corresponding focal ring extending at least partially around an imaginary cylinder 15. When the curved reflecting surface 17 completely surrounds the longitudinal center axis 11 a circular reflector 10 may be defined in a top view.

The curved reflecting surface 17 may be a focused-parabolic to maximize gain and aperture illumination efficiency. When a larger beamwidth is desired, the curved reflecting surface 17 may be defocused.

In the embodiment of FIG. 1, a center axis of the reflector 10 is coincidental with a center axis of the feed 20. Further, the reflector 10 may be configured and spaced relative to feed 20 so that a focal ring of the reflector 10 is coincidental with a feed phase center or feed ring of the feed 20.

In the later regard, the feed 20 may include an antenna 21 that generates a circularly symmetric radiation pattern, preferably with a null along the longitudinal center axis 11. For example, feed-ring antenna 21 may generate loop current ring(s) upon excitation, e.g. a spiral antenna, sinuous antenna or log-periodic antenna. In turn, the reflector may be designed to have a focal ring that is substantially centered on the center of the feed ring(s) of feed antenna 21. In one arrangement, a spiral feed antenna 21 having at least three spiral arms may be utilized for multimode operations (e.g. M>1), wherein higher mode radiation patterns are substantially unaffected by the post 30 as illustrated by the second and third mode patterns M2 and M3 in FIG. 1.

In the embodiment of FIGS. 1A and 1B, the feed antenna 21 may be of a planar configuration. For example, the feed antenna 21 may be defined by a plurality of spiral, sinuous or log-periodic elements disposed on a planar dielectric substrate. In turn, the planar feed antenna 21 may be mounted to a feed housing 22 to define a cavity-backed antenna structure. A free end of the post 30 may be interconnected with the feed housing 22 while the other end of the post 30 may be interconnected to the support structure 100.

As shown by FIG. 1, a lens 40 may be located over the feed antenna 21 to increase efficiency and aperture illumination. For example, a hemispherical, dielectric lens 40 may be utilized. As will be appreciated, the lens 40 may include an aperture therethrough to accommodate the passage of the post 30 to the feed antenna 21.

Preferably, post 30 is cylindrical with a passageway extending therethrough. In turn, feed cabling for feeding the feed antenna 21 may be advantageously routed through the cylindrical post 30 to additional feed componentry located on or within the support structure 100. By way of example, such feed componentry may comprise a multiplexer, low noise amplifier, beam-forming network, etc. To further facilitate the feed arrangement, the post 30 may be metallic and utilized as an outer conductor for the feed cabling.

By way of example only, the reflector 10 may be manufactured from aluminum, astroquartz, fiberglass, graphite composite or conductive mesh, the astroquartz and fiberglass surfaces being coated with copper or other electrical conductor. Any moderately reflective surface is suitable. For example, graphite has poor conductivity relative to standard metal conductors like copper and aluminum, but still performs satisfactorily.

Figure 2A:
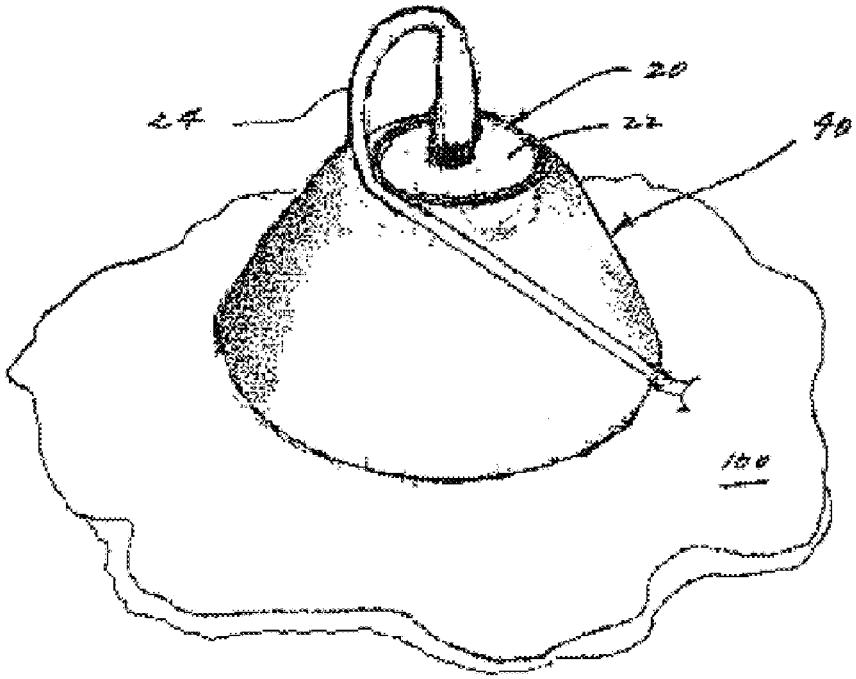
FIG. 2A illustrates a perspective view of a reflector antenna according to another embodiment of the present invention, wherein a radome is used to support a feed.
Figure 2B:
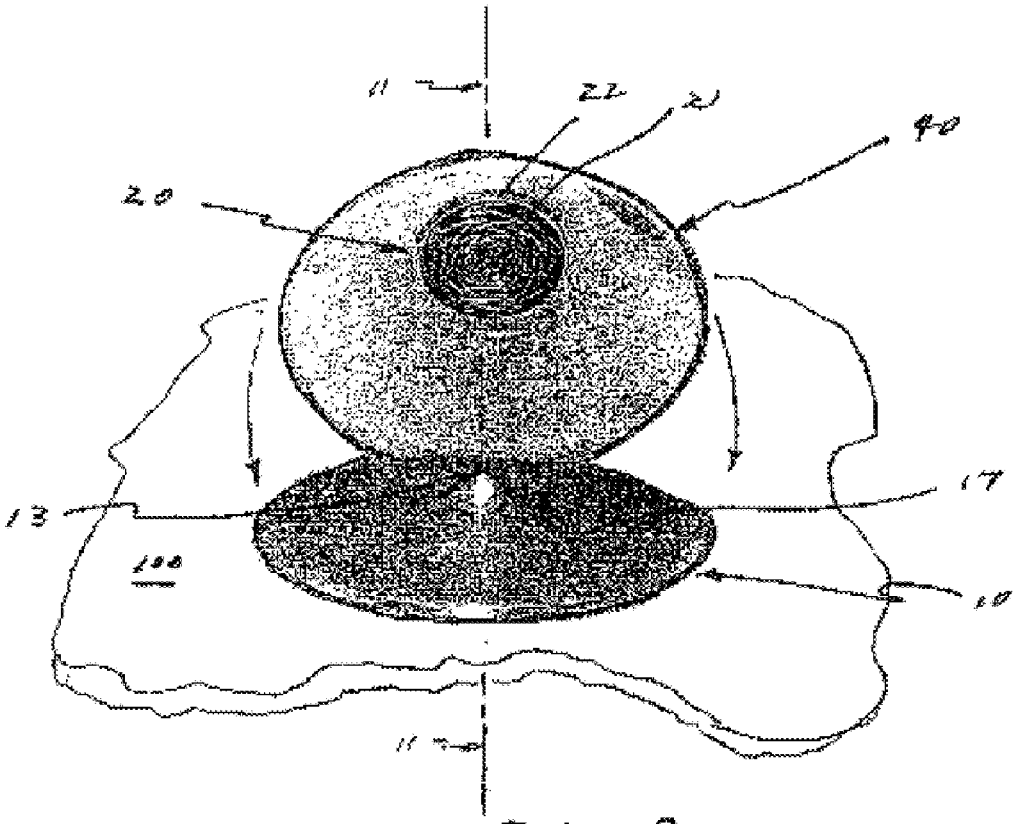
FIG. 2B illustrates a perspective view of the embodiment of FIG. 2A, wherein the radome has been lifted on one side to show the mounting of a feed antenna to the radome.

In the embodiment of FIGS. 2A and 2B, a paraconic reflector antenna comprises a reflector 10, a feed 20 and a radiolucent radome 40 that supports the feed 20 in opposing relation to the reflector 10. The reflector 10 and radome 40 may be mounted on a support structure 100, such as the deck of a spaceborne vehicle (e.g. a satellite). In operation, radiation beams are transmitted by feed 20 and reflected by reflector 10 through the radome 40 to obtain a wide-angle, conical pattern.

Again, a curved reflecting surface 17 may be defined by a curve whose focal point is located on or laterally offset from the longitudinal center axis 11. Of note, wherein an apex 13 may be formed on the reflector 10, wherein a continuous reflective surface is provided. In this regard, the curved reflecting surface 17 may generally define a cone-shape reflector 10 having dish-shaped sides in a side view.

In the embodiment of FIGS. 2A and 2B the feed 20 may comprise the same features as noted above in relation to the embodiment of FIGS. 1A and 1B, including for example, the use of a feed antenna 21 that provides a circularly symmetric radiation pattern. The reflector 10 has a focus point that is centered upon the center of the feed antenna 21.

For the embodiment of FIGS. 2A and 2B a feed housing 22 is mounted within the radome 40 via a central opening at a domed end thereof. As shown in FIG. 2B, the reflector 10 and feed 20 may be provided so that the longitudinal center axis 11 passes through the center of a feed antenna 21 and apex 13 of reflector 10.

As shown in FIG. 2A, feed cabling 24 is fed through the back of feed housing 22 to the feed antenna 21. The feed cabling 24 may include an absorber (e.g. carbon-based foam or honeycomb) for reducing radiation scatter. Further, the feed cabling 24 may be wound around the radome 40 at a predetermined angle to spread blockage over an azimuth. No more than a single winding is preferred. Feed cabling 24 may be interconnected with additional feed componentry mounted on or within the support structure 100.

Figure 3A:
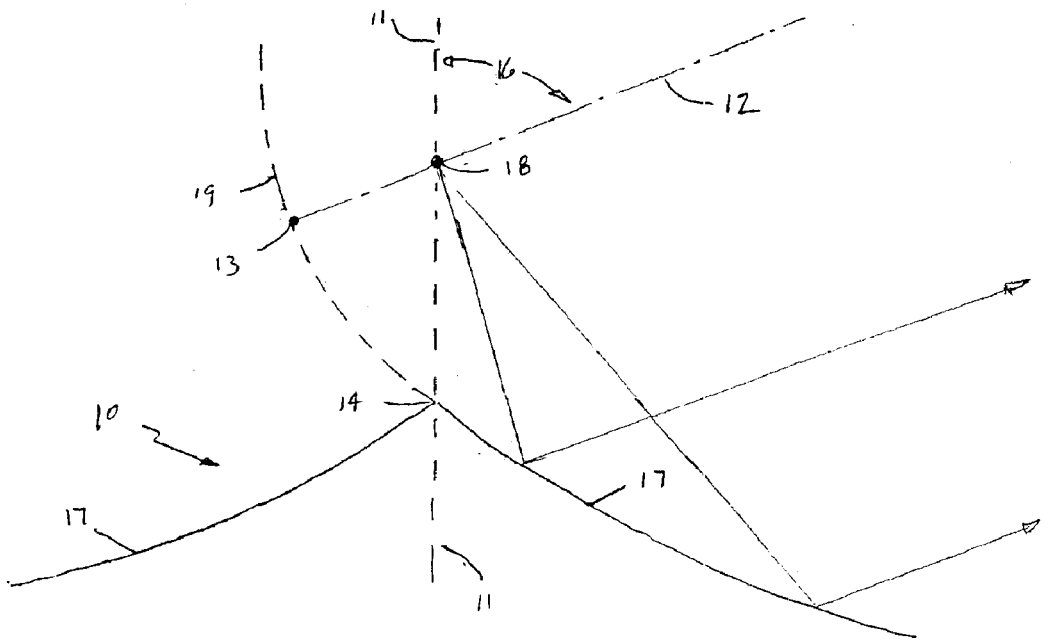
FIGS. 3A and 3B show how paraconic shapes of a reflector may be formed in various embodiments of the present invention.
Figure 3B:
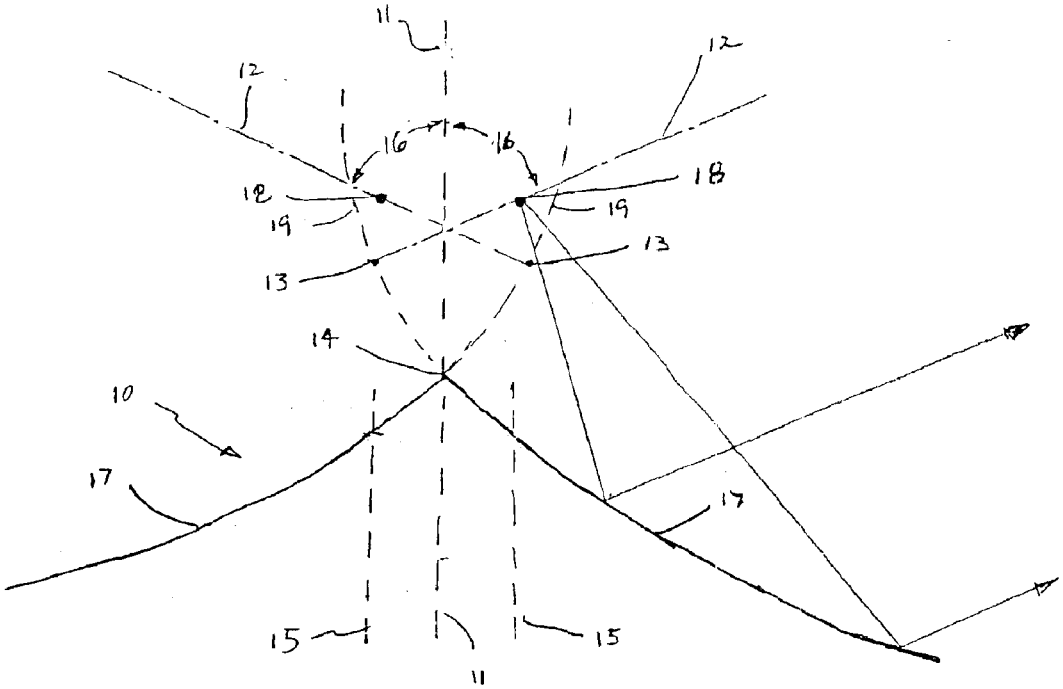

Referring now to FIGS. 3A and 3B, the formation of two reflectors 10 will be described in detail. In each case, a curved reflecting surface 17 is defined by rotating a curve 19 about a longitudinal center axis 11, wherein the curve 19 defines an apex 14 located on the longitudinal center axis 11. The curve 19 may be of a parabolic or non-parabolic configuration.

In the FIG. 3A arrangement the curve 19 is positioned so that a corresponding focal point 18 is located on the longitudinal center axis 11. As further shown in FIG. 3A, the curve 19 is disposed so that its vertex 13 and focal point 18 define an a major axis 12 that is tilted at an angle 16 relative to a longitudinal center axis 11. For typical spaceborne applications, the tilt angle 16 will generally be acute. As may be appreciated, the amount of tilt angle 16 may be selectively established to achieve the desired directional pointing characteristics of reflector 10.

Referring now to FIG. 3B it can be seen that curve 19 is positioned so that its focal point 18 is laterally displaced from the longitudinal center axis 11. In turn, the reflector 10 will have a focus ring that extends about an imaginary cylinder 15, wherein the radius of imaginary cylinder 15 corresponds with the lateral displacement of the focal point 18 from longitudinal center axis 11. Again, curve 19 may be positioned so that a corresponding vertex 13 and focal point 18 define a major axis 12 that is tilted at an angle 16 relative to the longitudinal center axis 11 to achieve the desired pointing characteristics of reflector 10.

As noted above, the reflecting surfaces 17 utilized in various embodiments may be selectively shaped to obtain the desired gain and coverage. To further illustrate this aspect, FIGS. 5A and 5B show gain/frequency and gain/beamwidth performance curves 100 and 102 corresponding with paraboloidal and non-paraboloidal reflector embodiments, respectively. As shown by FIG. 5A, a paraboloidal configuration may yield a higher gain at high frequencies. On the other hand, and as shown by FIG. 5B, a non-parabolic configuration may yield an acceptable gain across a larger beamwidth.

Figure 4A:
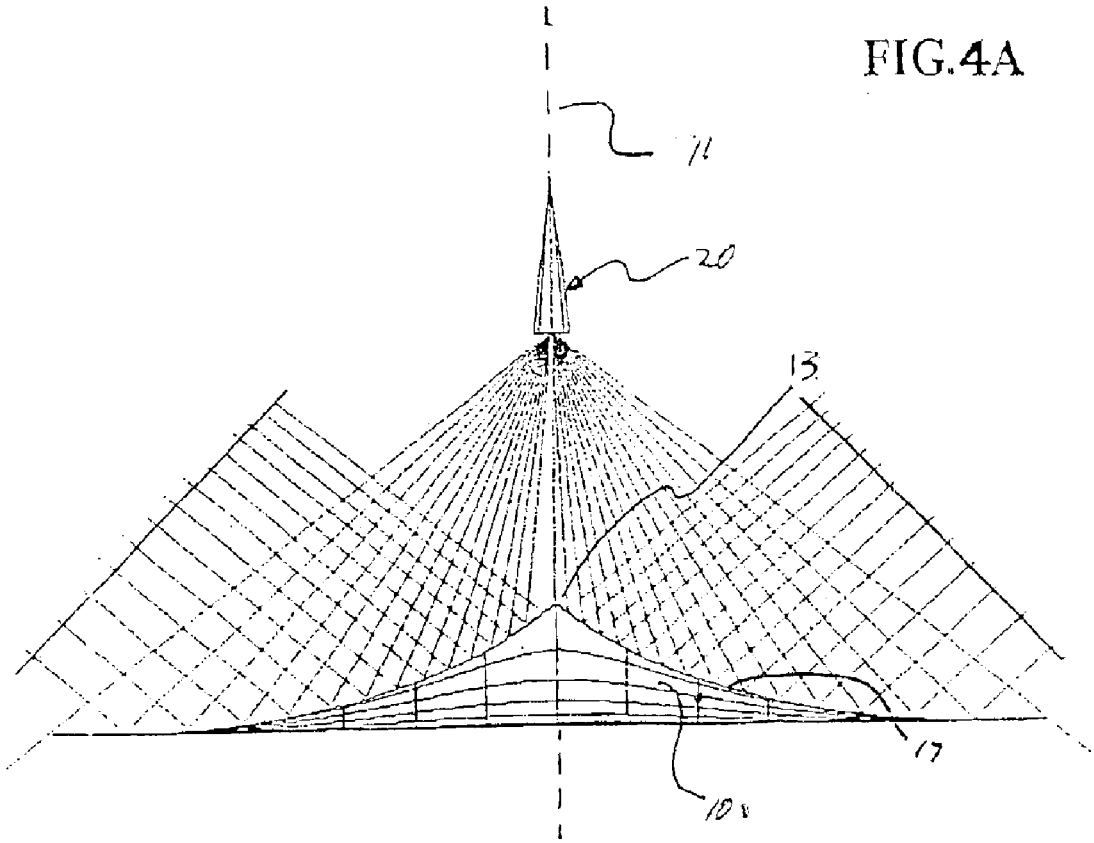
FIGS. 4A and 4B illustrate beam pointing capabilities of the present invention.
Figure 4B:
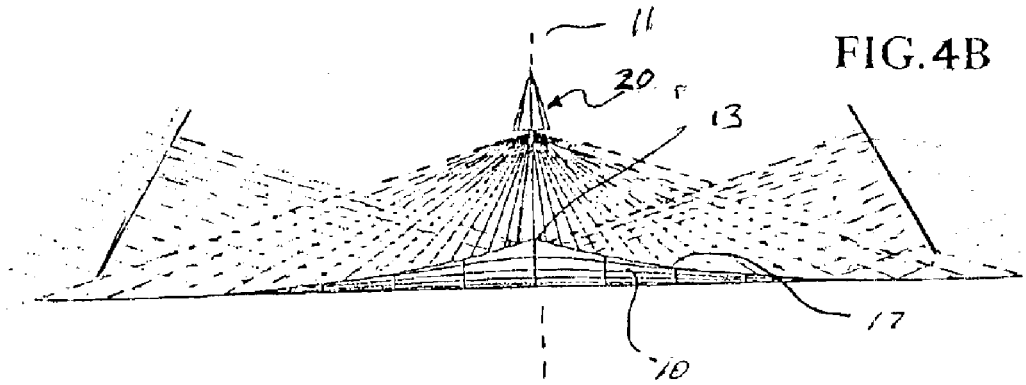

In addition to the foregoing, the configuration of reflector 10 and relative positioning of feed 20 and reflector 10 may be selectively established to yield the desired pointing angle. To further illustrate this aspect, reference is now made to FIGS. 4A and 4B. In each of the illustrated arrangements, a curved reflecting surface 17 of a reflector 10 is of a parabolic configuration. Further, the reflector 10 is provided so as to define a focal point that is coincidental with the center of a feed 10. In the FIG. 4A arrangement, the parabolic curved reflecting surface 17 is selected so that the reflected radiation from feed 10 creates a secondary beam focused to a pointing angle of about 45°. In the FIG. 4B arrangement, the parabolic reflecting surface 17 creates a secondary beam focused to a pointing angle of about 600.

FIGS. 6A–6F show examples of various feed antennas 21 that may be employed in the different embodiments. For example, FIGS. 6A, 6B and FIGS. 6C, 6E show four-arm and two-arm spiral antennas, respectively, while FIG. 6D shows an exemplary sinuous antenna. In each case, the illustrated antenna elements may be printed on a planar, conical or other appropriate dielectric substrate.

FIG. 7 is an exemplary beam plot for an eight-arm, spiral antenna feed. As illustrated, the spiral antenna has seven different radiating modes. Of note, the higher order modes (i.e. M>1) each yield minimal energy on a boresight. As such, the post 30 utilized in the embodiment of FIGS. 1A and 1B presents little or no pattern interference when employed therewith.

The embodiments described above are for exemplary purposes only and is not intended to limit the scope of the present invention. Various adaptations, modifications and extensions of the embodiment will be apparent to those skilled in the art and are intended to be within the scope of the invention as defined by the claims which follow.

What is claimed is:

1. A reflector antenna comprising:

a reflector having a curved reflecting surface that extends at least partially around a longitudinal center axis, wherein said curved reflecting surface is defined by rotating a concave curve at least partially around said longitudinal center axis, and wherein one end of the concave curve defines an apex on the longitudinal center axis; and a feed spaced from and supportably located in opposing relation to the reflectors, wherein said reflector has a single one of a focal point and focal ring that is coincidental with one of a feed phase center and feed focal ring of said feed.

2. A reflector antenna as recited in claim 1, wherein said feed comprises:

an antenna centered upon said longitudinal center axis.

3. A reflector antenna as recited in claim 1, further comprising:

a post for supporting said feed, wherein said post is located on said longitudinal center axis.

4. A reflector antenna as recited in claim 3, wherein said post is positioned in a center hole defined through the reflector.

5. A reflector antenna as recited in claim 3, wherein said feed comprises:

an antenna supportably interconnected to said post.

6. A reflector antenna as recited in claim 5, wherein said post has a passageway extending therethrough, and wherein said feed further comprises:

feed cabling interconnected to said feed antenna through said post passageway.

7. A reflector antenna as recited in claim 5, further comprising:

a lens positioned on said feed antenna and supportably interconnected to said post.

8. A reflector antenna as recited in claim 5, wherein said antenna provides a circularly symmetric radiation pattern.

9. A reflector antenna as recited in claim 8, wherein said feed antenna comprises a plurality of antenna elements disposed on a dielectric substrate, and wherein said feed further comprises:

a feed housing for receiving said dielectric substrate, wherein a cavity-backed antenna structure is defined.

10. A reflector antenna as recited in claim 5, wherein said feed antenna comprises:

one of a spiral antenna, sinuous antenna and log-periodic antenna.

11. A reflector antenna as recited in claim 10, wherein said feed antenna comprises:

a spiral antenna having at least three spiral arms for multimode operation.

12. A reflector antenna as recited in claim 5, wherein said curved reflecting surface is one of parabolic and non-parabolic.

13. A reflector antenna as recited in claim 12, wherein said curved reflecting surface completely surrounds said longitudinal center axis to define a reflector that is circularly symmetric with said antenna.

14. A reflector antenna as recited in claim 1, further comprising:

a radiolucent radome, disposed over said reflector, for internally supporting said feed in opposing relation to said reflector.

15. A reflector antenna as recited in claim 14, wherein said curved reflecting surface defines a center apex on the reflector.

16. A reflector antenna as recited in claim 15, further comprising:

a lens positioned on said feed antenna and supportably interconnected to said radome.

17. A reflector antenna as recited in claim 14, wherein said antenna provides a circularly symmetric radiation pattern.

18. A reflector antenna as recited in claim 17, wherein said feed antenna comprises:

one of a spiral antenna, sinuous antenna and log-periodic antenna.

19. A reflector antenna as recited in claim 18, wherein said feed antenna comprises a plurality of antenna elements disposed on a dielectric substrate, and wherein said feed further comprises:

a feed housing for receiving said dielectric substrate, wherein a cavity-backed antenna structure is defined.

20. A reflector antenna as recited in claim 18, wherein said feed antenna comprises:

a spiral antenna having at least three spiral arms for multimode operation.

21. A reflector antenna as recited in claim 17, wherein said curved reflecting surface is one of parabolic and non-parabolic.

22. A reflector antenna as recited in claim 21, wherein said curved reflecting surface completely surrounds said longitudinal center axis and is circularly symmetric with said feed antenna.

23. A reflector antenna comprising:

a reflector having a curved reflecting surface defined by rotating a curve at least partially around a longitudinal center axis, wherein the curve defines an apex on the longitudinal center axis;

a feed antenna spaced from and supportably located in opposing relation to the reflector; and, one of a post and a radiolucent radome for supporting said feed antenna.

24. A reflector antenna as recited in claim 23, comprising said post, wherein the post is positioned on said longitudinal center axis through a center hole defined through the reflector.

25. A reflector antenna as recited in claim 24, wherein said post has a passageway extending therethrough, and wherein feed cabling is interconnected to said feed antenna through said passageway.

26. A reflector antenna as recited in claim 25, wherein said post comprises:

an electrically conductive material, wherein at least one of said feed antenna and said feed cabling is electrically interconnected to said post.

27. A reflector antenna as recited in claim 24, further comprising:

a lens positioned on said feed antenna and supportably interconnected to said post.

28. A reflector antenna as recited in claim 23, wherein said feed antenna comprises:

a plurality of antenna elements disposed on a dielectric substrate, wherein said dielectric substrate is located within a feed housing to define a cavity-backed antenna.

29. A reflector antenna as recited in claim 23, wherein said feed antenna provides a circularly symmetric radiation pattern.

30. A reflector antenna as recited in claim 29, wherein said feed antenna comprises:

one of a spiral antenna, sinuous antenna and log-periodic antenna.

31. A reflector antenna as recited in claim 23, wherein said curve is one of parabolic and non-parabolic.

32. A reflector antenna as recited in claim 31, wherein said curved reflecting surface completely surrounds said longitudinal center axis to define a reflector that is circularly symmetric with said feed antenna.

33. A reflector antenna as recited in claim 32, wherein said reflector has one of a focal point and focal ring that is coincidental with one of a feed phase center and feed focus ring of said feed antenna.

34. A reflector antenna as recited in claim 32, wherein said curve has a corresponding vertex that is laterally displaced from the longitudinal center axis.

35. A reflector antenna as recited in claim 32, wherein said curve has a corresponding major axis that is tilted at an acute angle relative to said longitudinal center axis.

36. A reflector antenna as recited in claim 32, wherein said curve has a focal point located on the longitudinal center axis.

37. A reflector antenna as recited in claim 1, wherein said curved reflecting surface at least partially defines a cone shape having dish-shaped sides in a side view.

38. A reflector antenna as recited in claim 37, wherein said cone shape is truncated in said side view.

39. A reflector antenna as recited in claim 37, wherein said cone shape has an apex located on the longitudinal center axis in said side view.

* * * * *

UNITED STATES PATENT AND TRADEMARK OFFICE

CERTIFICATE OF CORRECTION

PATENT NO. : 6,844,862 B1
DATED : January 18, 2005
INVENTOR(S) : Cencich et al.

It is certified that error appears in the above-identified patent and that said Letters Patent is hereby corrected as shown below:

Column 7,
Line 27, delete “reflectors”, and insert therefor -- reflector --.

Signed and Sealed this

Nineteenth Day of April, 2005

JON W. DUDAS
*Director of the United States Patent and Trademark Office*